US009527129B2

(12) United States Patent
Chen

(10) Patent No.: US 9,527,129 B2
(45) Date of Patent: Dec. 27, 2016

(54) RIVETING TOOL

(71) Applicant: Li-Su Chen, Taichung (TW)

(72) Inventor: Li-Su Chen, Taichung (TW)

( * ) Notice: Subject to any disclaimer, the term of this patent is extended or adjusted under 35 U.S.C. 154(b) by 100 days.

(21) Appl. No.: 14/489,672

(22) Filed: Sep. 18, 2014

(65) Prior Publication Data

US 2016/0082500 A1 Mar. 24, 2016

(51) Int. Cl.
*B23P 11/00* (2006.01)
*B21J 15/38* (2006.01)
*B21J 15/04* (2006.01)

(52) U.S. Cl.
CPC ..... *B21J 15/386* (2013.01); *B21J 15/043* (2013.01)

(58) Field of Classification Search
CPC combination set(s) only.
See application file for complete search history.

(56) References Cited

U.S. PATENT DOCUMENTS 2,216,767 A * 10/1940 Davitow ..... B21J 15/043 29/243.521
3,154,210 A * 10/1964 Elliott ..... B21J 15/043 29/243.521
3,302,444 A * 2/1967 Elliott ..... B21J 15/043 29/243.528
3,646,800 A * 3/1972 Martin ..... B21J 15/043 29/243.528
3,760,627 A * 9/1973 Richardson ..... B21J 15/043 29/243.523
4,353,239 A * 10/1982 Fujimoto ..... B21J 15/043 29/243.528
5,729,880 A * 3/1998 Ko ..... B25B 27/0007 29/243.521
6,032,510 A * 3/2000 Smith ..... B21J 15/043 29/243.521
6,115,900 A * 9/2000 Cerulo ..... B21J 15/043 29/243.521
6,684,470 B1 * 2/2004 Joux ..... B21J 15/26 29/243.521
2004/0103513 A1 * 6/2004 Aasgaard ..... B21J 15/048 29/418
2011/0239449 A1 * 10/2011 Masugata ..... B21J 15/043 29/715

(Continued)

FOREIGN PATENT DOCUMENTS

DE 202011101657 U1 * 7/2011 ..... B21J 15/041

*Primary Examiner* — Alvin Grant

(57) ABSTRACT

A riveting tool contains: a body, a retaining post, and a pressing handle. The body includes an extending column, an accommodating cavity for accommodating the retaining post, one of plural adjusting heads selectively fixed into the accommodating cavity. The retaining post includes a movable clamping extension. The body also includes a grip and a returning spring for pushing the grip and the retaining post. The retaining post includes two recessed faces, the pressing handle includes two guiding pieces. Each guiding piece has a neck section, an arcuate section, and a reinforcing section. A curvature of the arcuate section is larger than that of the reinforcing section, such that when a distance between the grip and the pressing handle is expended to a maximum length, each guiding piece retains with the retaining post, and when the pressing handle is pushed toward the grip, each guiding piece pushes the retaining post.

2 Claims, 6 Drawing Sheets

(56) References Cited

U.S. PATENT DOCUMENTS

2011/0259622 A1* 10/2011 White ..... B21J 15/105
173/169
2011/0289745 A1* 12/2011 Ho ..... B21J 15/043
29/243.526

* cited by examiner

RIVETING TOOL

FIELD OF THE INVENTION

The present invention relates to a riveting tool which reduces a pressing stroke and eliminates a null pressing stork simultaneously.

BACKGROUND OF THE INVENTION

A conventional riveting tool is employed to punch rivets by which workpieces are connected together. For example, in a computer case assembling process, the rivets are punched into a computer case so that a magnetic rack is fixed in the computer case. In other words, the riveting tool punches the rivets into plural holes formed on the workpieces, and distal ends of the rivets are pulled by the riveting tool to rivet the workpieces together.

Referring to FIGS. 1 and 2, the conventional riveting tool contains a body 1, a retaining post 2, and a pressing handle 3. The retaining post 2 is mounted in the body 1, and the body 1 includes a grip 11 extending outwardly from one end thereof. The pressing handle 3 is rotatably coupled with the body 1 and is pressed toward the grip 11. The pressing handle 3 includes two guiding pieces 31 extending outwardly toward the retaining post 2 from one end thereof, such that the two guiding pieces 31 of the pressing handle 3 drive the retaining post 2 to move, thus pulling the rivets.

However, each guiding piece has an arcuate peripheral side, so when a distance between the pressing handle and the grip is in a maximum length, a corner of each guiding piece retains with the retaining post, and an opening between the pressing handle and the grip is too long to operate the conventional riveting tool with one hand easily. Moreover, a dull pressing stroke occurs.

Various embodiments of the present invention mitigate and/or obviate the afore-described disadvantages.

SUMMARY OF THE INVENTION

The primary object of the present invention is to provide a riveting tool which reduces a pressing stroke and eliminates a null pressing stork simultaneously.

To obtain the above object, a riveting tool provided by the present invention contains: a body, a retaining post, and a pressing handle.

The body includes an extending column extending outwardly from a first end thereof, an accommodating cavity defined in the body to accommodate the retaining post and extending toward an inner surface of the extending column, and one of plural adjusting heads selectively fixed into the accommodating cavity from an end surface of the extending column. The retaining post includes a movable clamping extension pressed by the one of the plural adjusting heads to adjust a size for corresponding to a rivet, the body also includes a grip extending outwardly from a second end thereof and is rotatably connected with the pressing handle, such that the grip is pressed toward the pressing handle. Also, the body further includes a returning spring for pushing the grip and the retaining post.

The retaining post includes two recessed faces formed on two sides thereof, the pressing handle includes two guiding pieces extending outwardly from one end thereof opposite to the retaining post and driving the retaining post, wherein each guiding piece has a neck section defined on a connecting portion of each guiding piece and the pressing handle, an arcuate section formed on a first peripheral side thereof, and a reinforcing section arranged on a second peripheral side thereof, wherein a curvature of the arcuate section is larger than that of the reinforcing section, such that when a distance between the grip and the pressing handle is expended to a maximum length, each guiding piece retains with the retaining post by ways of the neck section and the reinforcing section, and when the pressing handle is pushed toward the grip, each guiding piece pushes the retaining post by means of the arcuate section.

DETAILED DESCRIPTION OF THE PREFERRED EMBODIMENTS

Figure 1:
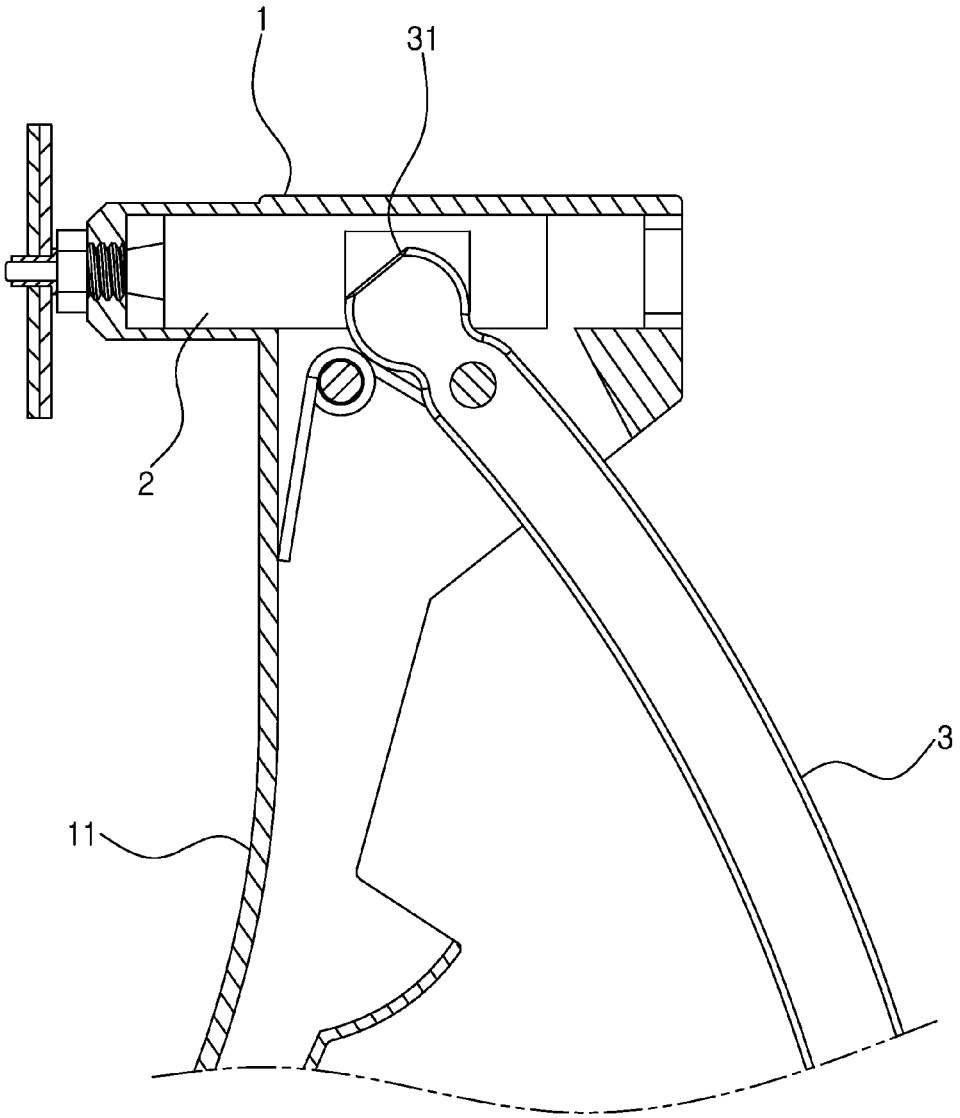
FIG. 1 Prior Art
FIG. 1 is a cross sectional view showing the assembly of a conventional riveting tool.
Figure 2:
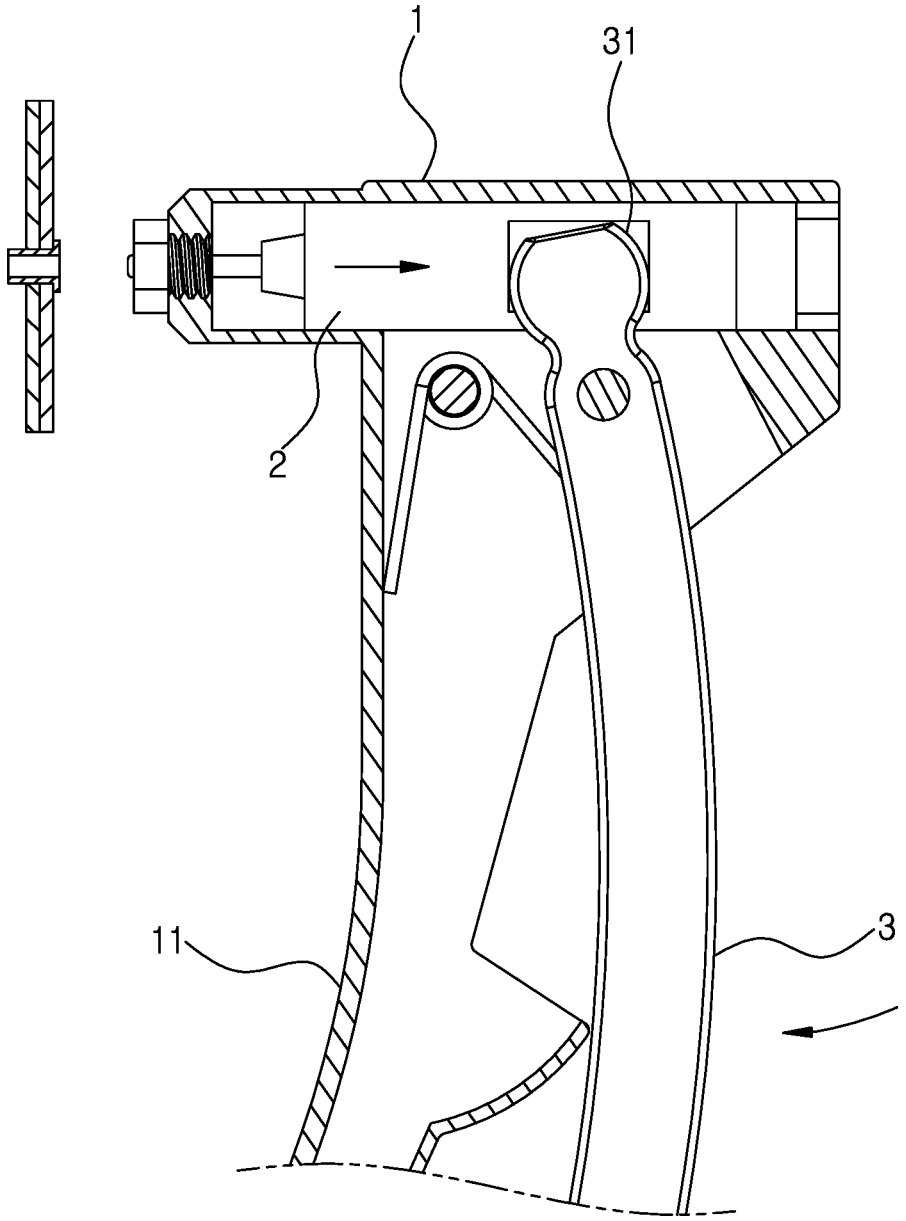
FIG. 2 Prior Art
FIG. 2 is a cross sectional view showing the operation of the conventional riveting tool.
Figure 3:
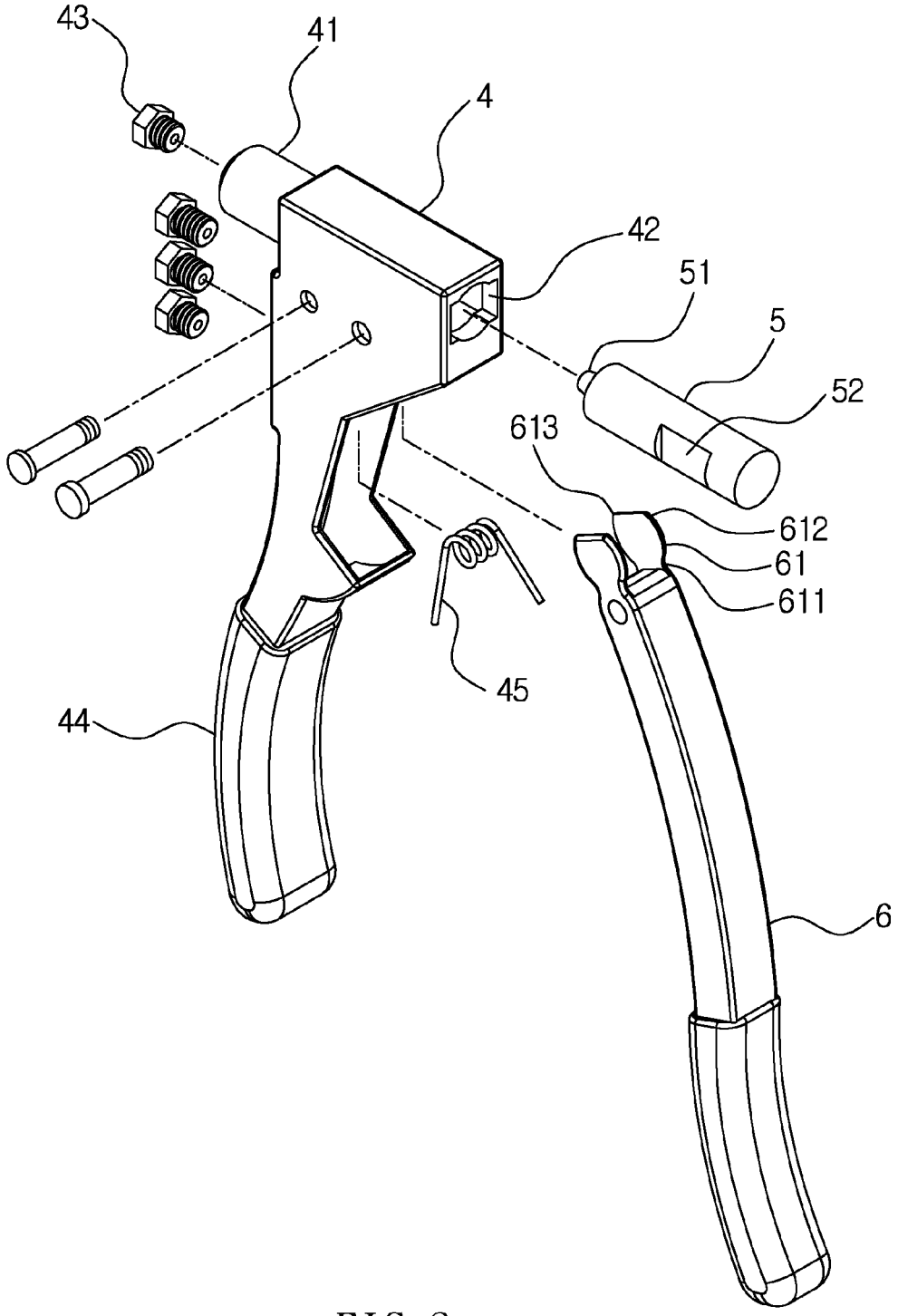
FIG. 3 is a perspective view showing the exploded components of a riveting tool according to a preferred embodiment of the present invention.
Figure 4:
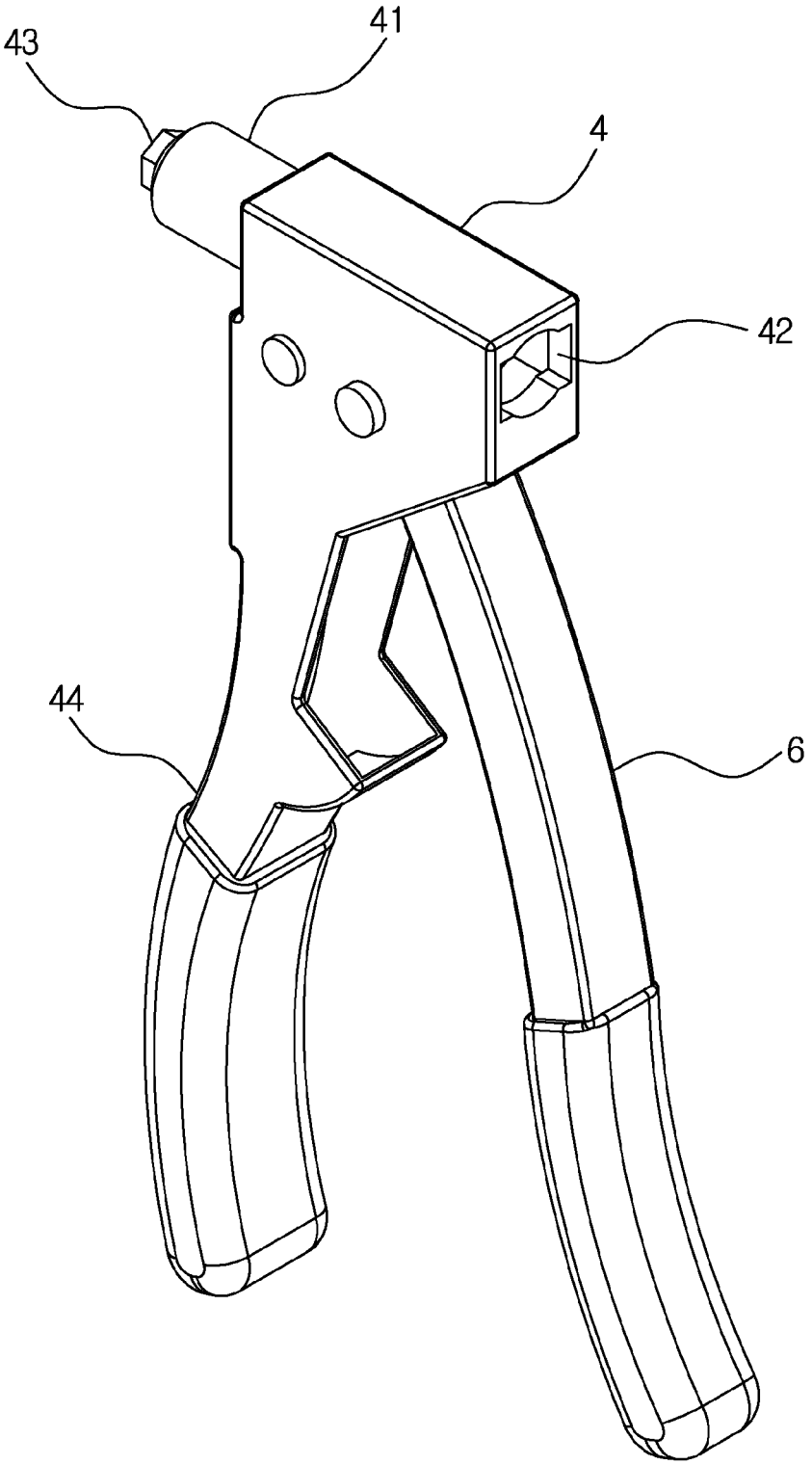
FIG. 4 is a perspective view showing the assembly of the riveting tool according to the preferred embodiment of the present invention.

With reference to FIGS. 3-6, a riveting tool according to a preferred embodiment of the present invention comprises: a body 4, a retaining post 5, and a pressing handle 6.

The body 4 includes an extending column 41 extending outwardly from a first end thereof, an accommodating cavity 42 defined in the body 4 to accommodate the retaining post 5 and extending toward an inner surface of the extending column 41, one of plural adjusting heads 43 selectively fixed into the accommodating cavity 42 from an end surface of the extending column 41. The retaining post 5 includes a movable clamping extension 51 pressed by the one of the plural adjusting heads 43 to adjust a size for corresponding to a rivet, wherein the movable clamping extension 51 clamps and pulls the rivet after a movement (since the movable clamping head 51 is a well-known prior art, further remarks, inclusive of its operation and structure, are omitted). The body 4 also includes a grip 44 extending outwardly from a second end thereof and is rotatably connected with the pressing handle 6, such that the grip 44 is pressed toward the pressing handle 6. The body 4 further includes a returning spring 45 for pushing the grip 44 and the retaining post 5.

Figure 5:
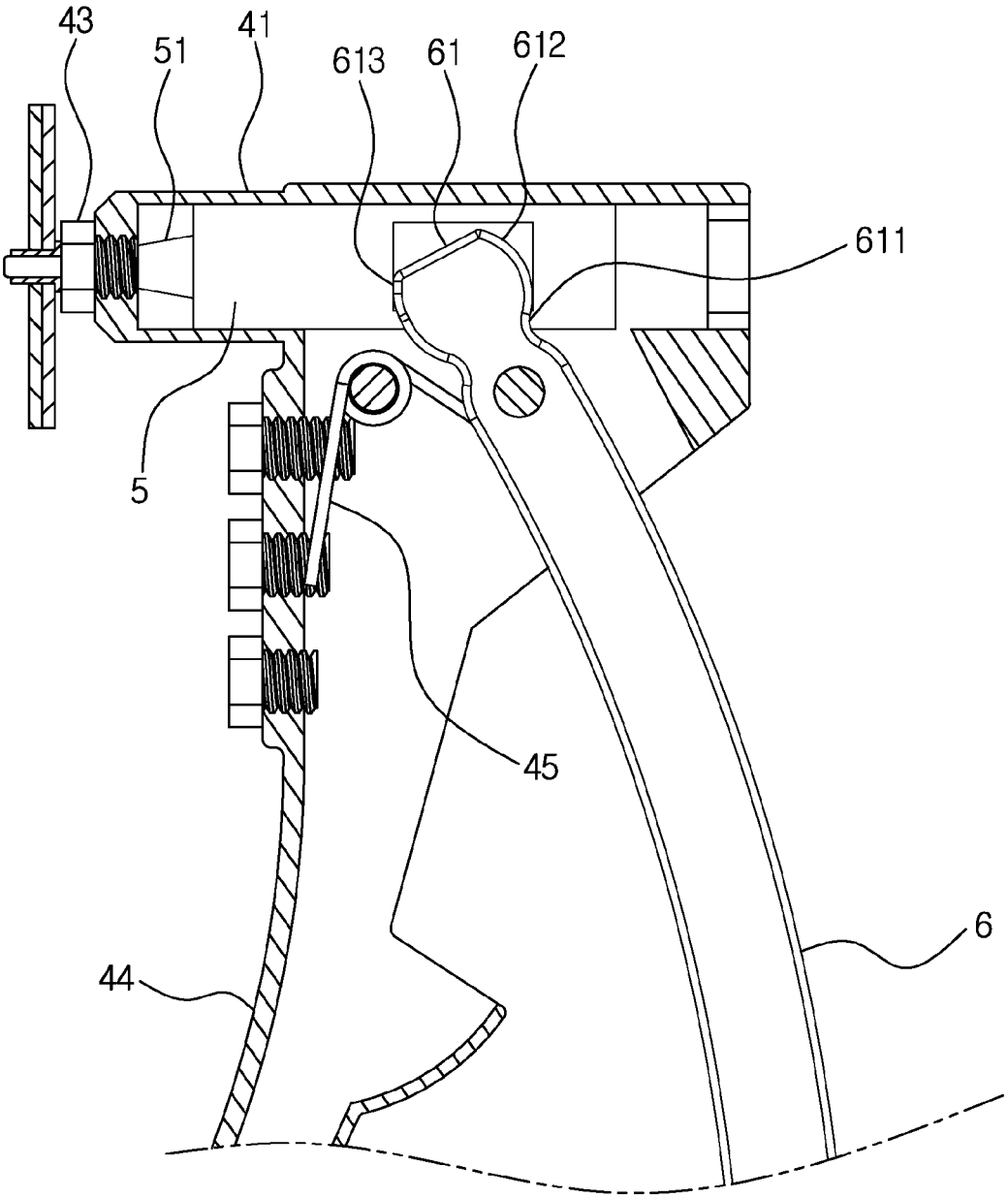
FIG. 5 is a cross sectional view showing the operation of the riveting tool according to the preferred embodiment of the present invention.
Figure 6:
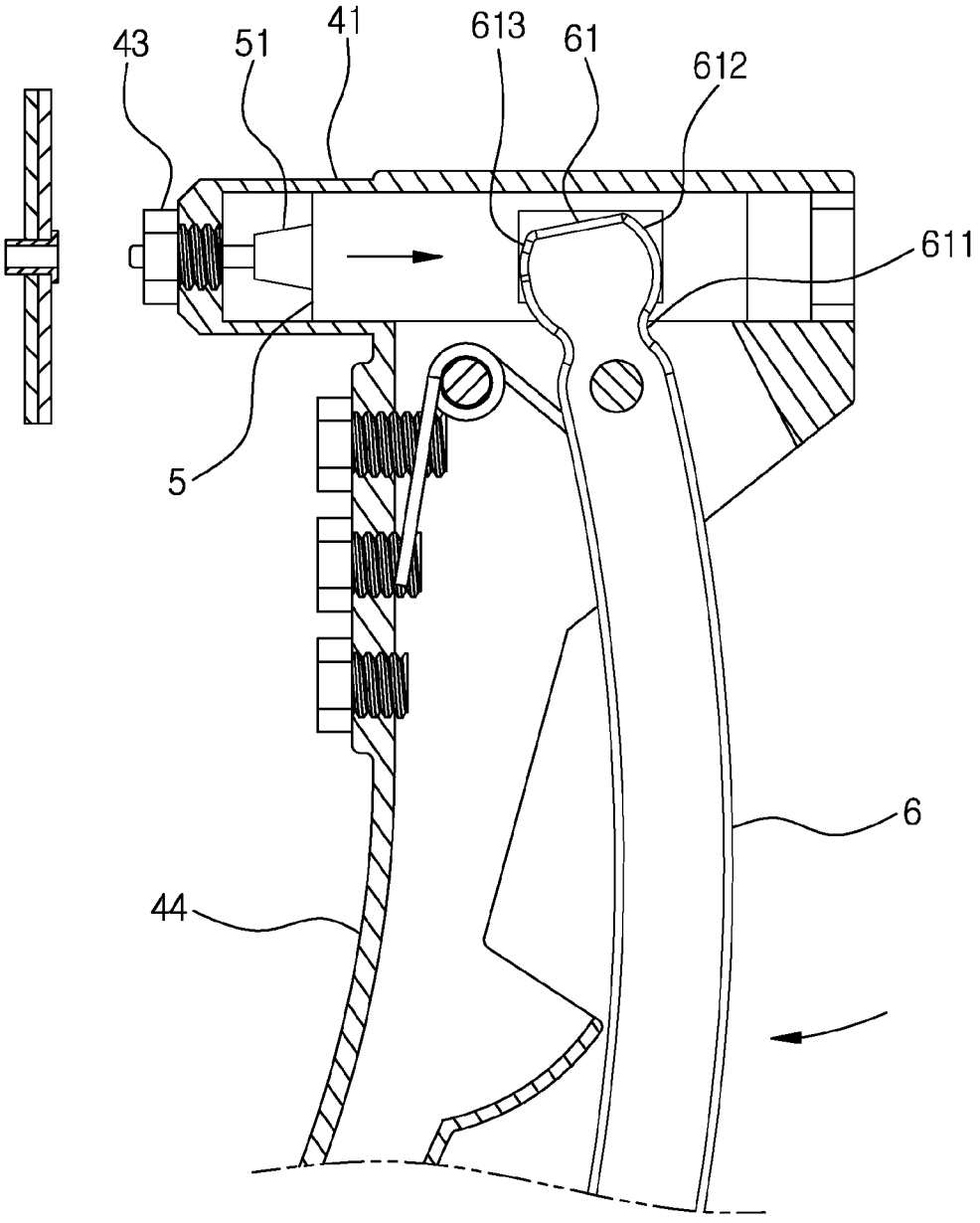
FIG. 6 is another cross sectional view showing the operation of the riveting tool according to the preferred embodiment of the present invention.

The retaining post 5 includes two recessed faces 52 formed on two sides thereof. The pressing handle 6 includes two guiding pieces 61 extending outwardly from one end thereof opposite to the retaining post 5 and driving the retaining post 5, wherein each guiding piece 61 has a neck section 611 defined on a connecting portion of each guiding piece 61 and the pressing handle 6, an arcuate section 612 formed on a first peripheral side thereof, and a reinforcing section arranged on a second peripheral side thereof, wherein a curvature of the arcuate section 612 is larger than that of the reinforcing section 613, such that when a distance between the grip 44 and the pressing handle 6 is expended to a maximum length, each guiding piece 61 retains with the retaining post 5 by ways of the neck section 611 and the reinforcing section 613 (as shown in FIG. 5), and when the pressing handle 6 is pushed toward the grip 44, each guiding piece 61 pushes the retaining post 5 by means of the arcuate section 612 (as illustrated in FIG. 6).

Furthermore, others of plural adjusting heads 43 with various of lengths are fixed on the grip 44, such that the one of the plural adjusting heads 43 is selectively removed from the grip 44 and is fixed into the accommodating cavity 42 from the end surface of the extending column 41 based on using requirement, hence a length of the movable clamping head 51 is controlled by using the plural adjusting heads 43 of various lengths to match with the rivet of various sizes.

Thereby, the reinforcing section 613 is applied to shorten the distance between the grip 44 and the pressing handle 6 so that the grip 44 and the pressing handle 6 are pressed by user's one hand easily. In addition, as pressing the grip 44 and the pressing handle 6, a distance between the retaining post 5 and the one of the plural adjusting heads 43 is longer than that of the conventional riveting tool, such that as using the one of the plural adjusting heads 43, the movable clamping head 51 is pressed slightly to reduce a clamping opening, thus eliminating a slit between the rivet and the clamping opening and decreasing a null pressing stork.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A riveting tool comprising:

a body, a retaining post, and a pressing handle;

the body including:

an extending column extending outwardly from a first end thereof, an accommodating cavity defined in the body to accommodate the retaining post and extending toward an inner surface of the extending column, and one of a plurality of adjusting heads selectively fixed into the accommodating cavity from an end surface of the extending column, the retaining post including a movable clamping extension pressed by the one of the plurality of adjusting heads for size adjustment corresponding to a rivet, the body also including a grip extending outwardly from a second end thereof and being rotatably connected with the pressing handle, such that the grip is pressable toward the pressing handle, the body further including a return spring for pushing the grip and the retaining post;

the retaining post including two recessed faces formed on two sides thereof, the pressing handle including two guiding pieces extending outwardly from one end thereof and corresponding to the two recessed faces of the retaining post for driving the retaining post, wherein each guiding piece has a neck section connecting the respective guiding piece with the pressing handle, a first section formed on a first peripheral side thereof, and a second section arranged on a second peripheral side thereof, wherein a curvature of the first section is larger than that of the second section, such that when a distance between the grip and the pressing handle is extended to a maximum length, each guiding piece engages with the retaining post at the neck section and the second section, and when the pressing handle is pushed toward the grip, each guiding piece pushes the retaining post by means of the first section.

2. The riveting tool as claimed in claim 1, wherein others of the plurality of adjusting heads have various lengths and are fixable on the grip.

* * * * *